United States Patent [19]

Klemm

[11] Patent Number: 4,628,814

[45] Date of Patent: Dec. 16, 1986

[54] FLAT SCREEN PRINTING MACHINE

[76] Inventor: Gerhard Klemm, Am Rehwinkel 37, D-4800 Bielefeld, Fed. Rep. of Germany

[21] Appl. No.: 653,691

[22] Filed: Sep. 21, 1984

[30] Foreign Application Priority Data

Sep. 23, 1983 [DE] Fed. Rep. of Germany ..... 3334444

[51] Int. Cl.[4] ..... B41L 13/02; B41L 13/16

[52] U.S. Cl. ..... 101/123; 101/256; 101/126

[58] Field of Search ..... 101/123, 256, 126

[56] References Cited

U.S. PATENT DOCUMENTS

| | | | |
|---|---|---|---|
| 376,053 | 1/1888 | Stonemetz | 101/256 |
| 459,813 | 9/1891 | Cox | 101/256 |
| 634,311 | 10/1899 | Svensson | 101/256 |
| 1,861,611 | 6/1932 | Respress | 101/123 |
| 3,834,348 | 9/1974 | Black | 101/123 |
| 3,848,528 | 11/1974 | Seedorf | 101/115 |
| 3,859,917 | 1/1975 | Bubley | 101/123 |
| 3,889,629 | 6/1975 | Black | 101/123 |
| 4,063,503 | 12/1977 | Ichinose | 101/123 |
| 4,121,519 | 10/1978 | Porth | 101/123 |
| 4,173,928 | 11/1979 | Mitter | 101/123 |
| 4,245,554 | 1/1981 | Kammann | 101/123 |
| 4,307,662 | 12/1981 | Mitter | 101/123 |
| 4,389,936 | 6/1983 | Jaffa | 101/123 |

FOREIGN PATENT DOCUMENTS

| | | | |
|---|---|---|---|
| 1204747 | 8/1959 | France | 101/123 |
| 878094 | 9/1961 | United Kingdom | 101/123 |

*Primary Examiner*—Clyde I. Coughenour
*Attorney, Agent, or Firm*—Peter K. Kontler

[57] ABSTRACT

A printing machine for webs of paper or the like has a flat horizontal screen which is stationarily but removably mounted in the machine frame above the path of intermittent longitudinal movement of the web. A hollow air-permeable counterpressure cylinder is mounted below the path of the web and is reciprocable relative to the screen with a carriage which further supports a printing medium applying unit at a level above the screen. The cylinder is rotated during the printing stroke while a first squeegee of the applying unit forces printing medium through the screen and into contact with the web. During the next-following return stroke, the cylinder is held against rotation and a second squeegee of the applying unit spreads out the printing medium on the screen. At the same time, the web is advanced forwardly through a preselected distance. The carriage can move the applying unit to a position laterally of and out of register with the screen; at such time, the squeegees are located above an open-top pan which is mounted in the frame, and the entire screen is then accessible from above.

16 Claims, 7 Drawing Figures

FLAT SCREEN PRINTING MACHINE

BACKGROUND OF THE INVENTION

The present invention relates to screen printing machines in general, and more particularly to improvements in flat screen printing machines of the type wherein the screen cooperates with a counterpressure member and the path for the material which is to be provided with printing medium extends between the screen and the counterpressure member.

Screen printing machines of the above outlined character are disclosed, for example, in U.S. Pat. No. 3,120,180. In certain presently known flat screen printing machines, the screen is reciprocable in the upper portion of the machine frame and a stationary cylindrical counterpressure member is rotatably mounted in the central portion of the frame at a level below the screen. The counterpressure member is arranged to pull the material into the machine. A drawback of such machines is that they occupy an inordinately large amount of space because the entire screen must be moved to both sides of the counterpressure member. As a rule, the just described machines are used for the application of printing media to workpieces (e.g., paper sheets) of finite length.

In the so-called flat bed printing machines, the screen is placed on top of the workpiece. A squeegee is thereupon caused to move back and forth within the confines of the screen and to force the printing medium through the interstices of the screen and into contact with the workpiece. The screen is thereupon lifted, the workpiece is shifted relative to the frame so as to locate an untreated portion at the printing station, and the cycle is repeated. A drawback of such machines is that the screen must be lifted off the workpiece together with a pool of printing medium thereon which creates problems during actual separation from the workpiece as well as during renewed movement of the screen into surface-to-surface contact with an unprinted portion of the workpiece. This often results in smudging of the screen and/or workpiece and can affect the appearance of the pattern which is applied to the workpiece. In many respects, the aforediscussed machines with reciprocable screens operate more satisfactorily than a flat bed printing machine wherein the screen is stationary in the course of the printing operation. Thus, the application of printing medium is more predictable and the workpiece as well as the screen are less likely to be contaminated by printing medium in regions which should not be contacted by such medium or (in the case of the workpiece) are already coated with an ink, a dye, a lustre enhancing medium or the like.

OBJECTS AND SUMMARY OF THE INVENTION

An object of the invention is to provide a flat screen printing machine which embodies the advantages but does not embody the drawbacks of heretofore known machines.

Another object of the invention is to provide a machine which embodies all advantages of machines with reciprocable screens but occupies only a fraction of the space which is taken up by a conventional machine.

A further object of the invention is to provide a machine wherein the screen is more readily accessible, insertable and removable than in heretofore known machines.

An additional object of the invention is to provide the machine with novel and improved means for mounting the counterpressure member.

Still another object of the invention is to provide the improved machine with novel means for supporting and manipulating the means for applying printing media to workpieces.

Another object of the invention is to provide a machine which can apply printing media to continuous workpieces or to workpieces of finite length.

A further object of the invention is to provide a machine which is especially suited for intermittent application of printing media to successive lengths of continuous webs of paper, textile material or the like.

An additional object of the invention is to provide a novel and improved method of applying printing media to successive lengths of paper webs or the like.

Another object of the invention is to provide novel and improved means for feeding the workpiece into the above outlined flat screen printing machine.

The invention is embodied in a machine for screen printing an elongated web of paper, textile or other flexible sheet-like material. The machine comprises a support (e.g., the housing or frame of the machine), a flat stationary printing screen which is preferably removably mounted in or on the support so that its partly or fully permeable section or sections are preferably located in or close to a horizontal plane, a counterpressure member which is adjacent to one side of the screen (preferably to the underside of the permeable section or sections of the screen), means for positioning the web between the counterpressure member and the one side of the screen, and means for reciprocating the counterpressure member along the one side of the screen. The reciprocating means preferably comprises a carriage for the counterpressure member and means for reciprocating the carriage relative to the screen.

The machine preferably further comprises at least one skew preventing device for the web, and such device is also mounted on and thus shares the reciprocatory movements of the carriage. In accordance with a presently preferred embodiment of the invention, the machine comprises two mutually inclined skew preventing devices on or in the carriage. Such devices can be said to constitute components of the web positioning means. The means for applying a printing medium to the web preferably comprises one or more applicators which are also mounted on and reciprocate with the carriage at the other side of the properly installed screen. For example, one of the applicators can comprise means for supplying the printing medium to and/or for spreading the medium on the other side of the screen, and another applicator can comprise means for causing the supplied printing medium to pass through the screen and into contact with the web. The carriage can be provided with two spaced-apart parallel sidewalls for carrier means which support the printing medium applying means. The support preferably comprises ways (e.g., two spaced-apart parallel rails) and the carriage includes a portion (e.g., two sets of roller followers or skid-shaped followers) which is supported by and is reciprocable along the ways.

The counterpressure member can comprise a hollow air-permeable rotary cylindrical shell and means for evacuating air from the interior of the shell so that the latter attracts the adjacent portion of the web. Such machine preferably further comprises means for intermittently rotating the shell about its axis.

The positioning means preferably comprises means for advancing the web in a predetermined direction and along a predetermined path. The counterpressure member is reciprocable in and counter to the just mentioned direction and the advancing means can further include means for stabilizing the web downstream of the counterpressure member, as considered in the direction of transport of the web. Such stabilizing means can include a hollow air-permeable cylindrical shell which is adjacent to the path of movement of the web, means for evacuating air from the interior of the shell so that the latter attracts the adjacent portion of the web, and means for intermittently rotating the shell.

The machine can further comprise monitoring means which is adjacent to the path of movement of the web, preferably immediately adjacent to and upstream of the counterpressure member, as considered in the direction of transport of the web. Such monitoring means can comprise one or more photocells and/or one or more web perforating devices, e.g., one photocell for each marginal portion of the web and/or one perforating device for each marginal portion of the web.

The means for feeding the web into the aforementioned predetermined path preferably includes a plurality of rotary elements which define for the web a preferably meandering second path and means for intermittently rotating at least one of the rotary elements. Such feeding means preferably further comprises rocker means (e.g., several two-armed levers pivotably mounted in the frame of the screen printing machine) for pivotably mounting at least two rotary elements of the feeding means. The web is looped around the rotary elements on the rocker means, preferably in such a way that it forms a discrete loop for each of the rotary elements on the rocker means and each of these rotary elements is located in the bight of the respective loop. The upper portion of the feeding means is preferably adjacent to the receiving end of the predetermined path and the aforementioned rocker means with the rotary elements thereon is preferably installed in or constitutes the lower portion of the feeding means.

In accordance with one of the presently preferred embodiments of the invention, the carriage is preferably reciprocable to and from a predetermined end position in which the means for applying the printing medium is disposed laterally of and is not in register with the screen so that the latter can be readily removed from the support, inspected and/or otherwise treated without any interference on the part of the applying means. Such machine preferably further comprises an open-top vessel which is mounted in or below the support at a level below the applicator or applicators of the applying means so that any printing medium which might drip from the applicator or applicators while the carriage assumes its predetermined end position gathers in the vessel. Thus, the length of the ways for the follower means of the carriage can be selected in such a way that the screen is supported adjacent to a first portion of the ways and the carriage with its printing medium applying means is adjacent to a different second portion of such ways when it assumes the aforementioned predetermined end position.

The means for applying the printing medium can be movably mounted on the carriage, and the machine can further comprise means for moving the applying means up and down and/or for pivoting the applying means relative to the carriage about a preferably horizontal axis which extends transversely of the path of movement of the web between the screen and the counterpressure member.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
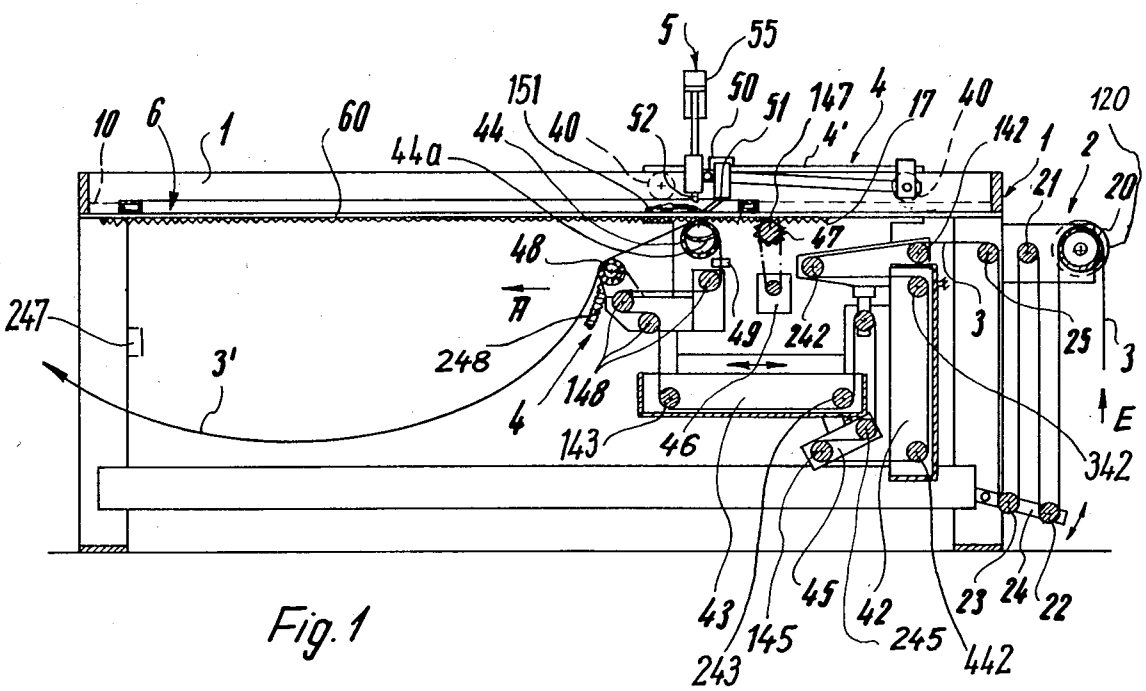
FIG. 1 is a longitudinal vertical sectional view of a screen printing machine which embodies one form of the invention, the carriage with the counterpressure member and the applicators being shown in a position it assumes upon completion of a printing stroke and the section being taken in the direction of arrows as seen from the line I—I in FIG. 3.
Figure 2:
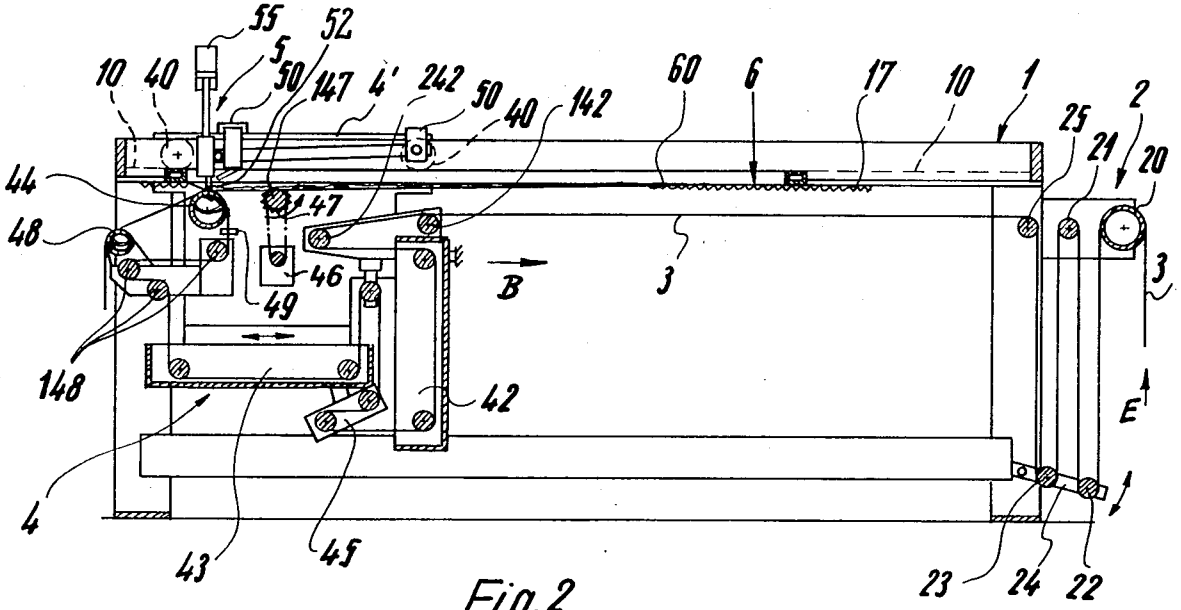
FIG. 2 shows the structure of FIG. 1, with the carriage in a position it assumes upon completion of a return stroke.
Figure 3:
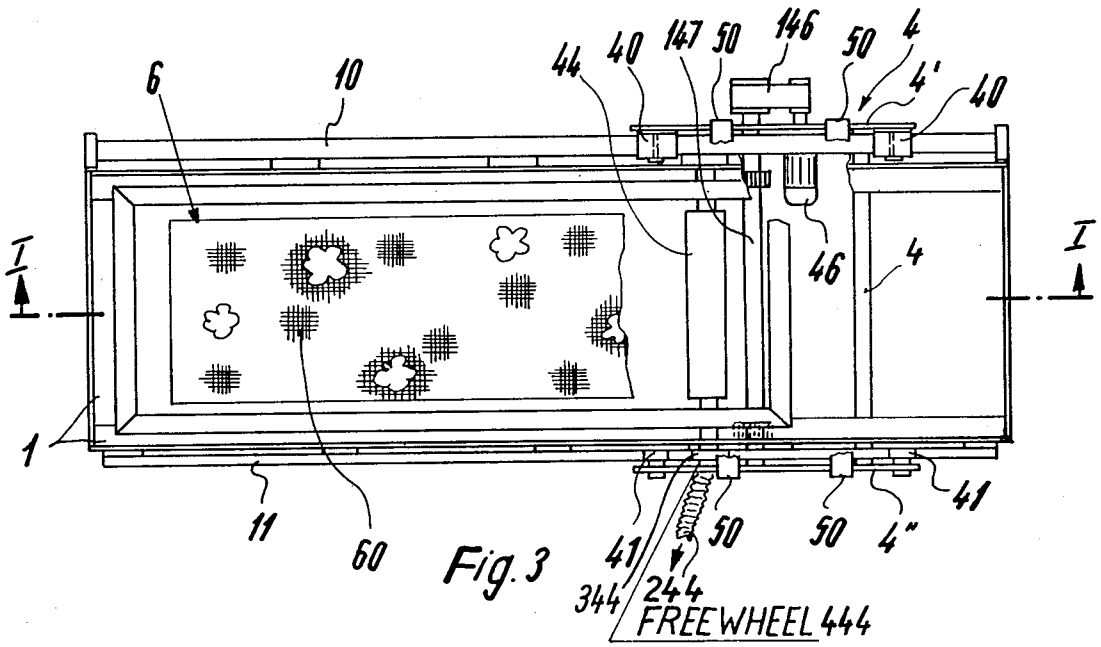
FIG. 3 is a plan view of the machine which is shown in FIGS. 1 and 2.

Referring first to FIGS. 1 to 3, there is shown a screen printing machine which comprises a support 1 constituting a frame or housing and supporting the frame of a screen 6 having a flat, horizontal and at least partially foraminous section 60. The unit 2 which feeds the web 3 into the positioning means of the machine is located to the right of the support 1, and the web 3 is intermittently advanced into and through the machine in the direction which is indicated by the arrow A. The web 3 may consist of paper, metallic or plastic foil, non-woven textile material, woven textile material or a combination of two or more different materials.

In accordance with a feature of the invention, the underside of the stationary screen 6 is adjacent to one side of an elongated predetermined path for the web 3 and the underside of the web is adjacent to a mobile counterpressure member 44 which is reciprocable in and counter to the direction indicated by the arrow A. The means for reciprocating the counterpressure member 44 comprises a carriage 4 and means for reciprocating the carriage relative to the screen 6. The support 1 is provided with or carries elongated ways in the form of horizontal rails 10 and 11 which are respectively tracked by pairs of roller followers 40, 41 on the carriage 4. Such roller followers can be replaced with or used jointly with skids without departing from the spirit of the invention. The rails 10, 11 flank the longer sides of the screen 6 (see FIG. 3). The carriage 4 further supports a unit 5 which constitutes a means for applying one or more printing media to the web 3 through the interstices of the foraminous section 60 of the screen 6, and the unit 5 is located at a level above the upper side of the screen 6. To this end, the carriage 4 comprises two spaced parallel sidewalls or cheeks 4', 4'' which are outwardly adjacent to the respective rails 10, 11 and serve as supports for pairs of carriers or mounting means 50 for the unit 5.

While it is possible to provide a separate carriage for the unit 5 and separate drive means for moving the separate carriage relative to the screen 6, the illustrated machine (wherein the unit 5 is mounted directly on the carriage 4 for the counterpressure member 44) is preferred at this time because it is simpler, more compact, less expensive and at least as satisfactory as a machine with a discrete carriage for the unit 5. The carriage 4 preferably further supports at least one skew preventing device for the web 3. In the embodiment of FIGS. 1 to 3, the carriage 4 supports two mutually inclined skew preventing devices 42 and 43. Successive increments of the web 3 which advance from the device 42 toward the device 43 must pass over the rollers 145, 245 of a deflector 45 which is mounted on and shares the reciprocatory movements of the carriage 4.

The means for reciprocating the carriage 4 relative to the support 1 and screen 6 comprises a reversible prime mover 46, e.g., an electric motor which is mounted on the carriage and whose output element transmits torque to a toothed belt or chain transmission 146. The output element of the transmission 146 drives a stabilizing and synchronizing shaft 147 for two coaxial pinions 47 in mesh with stationary toothed racks 17 on the support 1. The racks 17 are adjacent to the rails 10, 11 and the shaft 147 is horizontal and extends transversely of the direction (arrow A) of forward movement of the web 3. Limit switches 247 can be provided in or on the support 1 to reverse the direction of rotation of the output element of the prime mover 46 when the carriage 4 reaches the one or the other end of its path. FIG. 1 merely shows a single limit switch 247 which is actuated by a trip on the carriage 4 or directly by the carriage when the latter reaches its lefthand end position. The movement of the carriage 4 in the opposite direction can be terminated and the direction of rotation of the output element of the prime mover 46 reversed by one or more additional limit switches in or on the support 1.

The means for intermittently rotating the cylindrical counterpressure member 44 comprises at least one pinion 344 (FIG. 3) which meshes with one of the racks 17 and a one-way clutch 444 (e.g., a commercially available freewheel which is indicated by a legend) interposed between the pinion 344 and the counterpressure member 44 so that the latter is rotated only while the carriage 4 moves in one direction but is free to remain at a standstill (as far as rotation about its own axis is concerned) while the carriage 4 moves in the other direction. The freewheel 444 is installed in such a way that the counterpressure member 44 need not rotate while the carriage 4 is caused to move in the direction which is indicated by the arrow A. The freewheel 444 is designed to transmit torque from the rotating pinion 344 to the counterpressure member 44 while the carriage 4 moves in the opposite direction (note the arrow B in FIG. 2).

The counterpressure member 44 preferably comprises a hollow foraminous (air-permeable) cylindrical shell and means (including the flexible hose 244 shown in FIG. 3) for evacuating air from a portion of or from the entire interior of the shell of the member 44. The intake end of the hose 244 is connected to one end portion of the member 44 and the discharge end of the hose 244 is connected to a suitable suction pump or another suction generating device, not shown. The arrangement is preferably such that the shell of the member 44 surrounds a stationary segment-shaped member **44*a* which is adjacent to the uppermost portion of such shell (directly below the adjacent portion of the web 3) and from which the hose 244 draws air when the machine is in use. The top wall of the segment-shaped member 44*a* is foraminous, slotted or removed so that the interior of the member 44*a* constitutes a suction chamber which attracts the adjacent portion of the web 3 through the pores or holes of the uppermost part of the air-permeable shell of the member 44. A counterpressure member which includes an air-permeable shell and means for evacuating air from the interior of its shell is disclosed, for example, in German Pat. No. 29 43 894. The illustrated member 44** can be said to constitute a counterpressure cylinder.

The carriage 4 further supports a stabilizing device 48 which is disposed downstream of the member 44, as considered in the direction of arrow A, and attracts the adjacent portion of the web 3. The construction of the stabilizing device 48 is preferably identical with that of the counterpressure member 44, i.e., the device 48 also comprises a hollow air-permeable cylindrical shell from which air is evacuated by way of a flexible hose 248 and which can be intermittently rotated by one or more pinions meshing with the respective toothed rack or racks 17 and being mounted on suitable one-way clutch means such as the aforediscussed freewheel 444.

FIG. 1 shows the carriage 4 with the counterpressure member 44 and unit 5 in the starting position upon completion of a printing stroke. A motor 120 drives a rotary element 20 of the feeding unit 2 which supplies the web 3 in the direction indicated by the arrow E. The rotary element 20 draws the web 3 off a supply reel (not shown) and the imprinted lengths of the web 3 are collected by a takeup reel which is or can be located to the left of the support 1, as viewed in FIG. 1, 2 or 3. The feeding unit 2 comprises an upper portion which includes the aforementioned driven rotary element 20 and a second rotary element 21. The lower portion of the feeding unit 2 includes two additional rotary elements 22, 23 which are pivotable with a rocker 24 secured to the support 1 at a level below the rotary elements 20, 21. The motor 120 can be arranged to drive two, three or all four rotary elements of the unit 2. As can be seen in FIGS. 1 and 2, the rotary elements 20–23 define for the web 3 a meandering path in that the web 3 is looped individually around each rotary element (i.e., each element is located in the bight of the respective loop) so that the feeding unit 2 constitutes a small reservoir for the web 3 immediately ahead of the positioning means for the web in the support 1 of the screen printing machine. The rocker 24 is preferably biased in a clockwise direction, as viewed in FIG. 1 or 2, so as to ensure that the web 3 which is about to enter the path defined by the aforementioned positioning means is under requisite tension. Such tensioning ensures more predictable delivery of preselected lengths of the web 3 upon completion of each printing stage. The rocker 24 preferably comprises two spaced-apart two-armed levers which are mounted in the support 1 and support the respective end portions of the rotary elements 22, 23.

The web positioning means comprises a roller 25 which is mounted directly in the support 1 adjacent to the upper portion of the feeding unit 2 and over which the web 3 is trained on its way toward two additional rollers 142, 242 which are mounted in the carriage 4. From the roller 242, successive increments of the web 3 advance toward and are trained over the rollers 342,442 of the first skew preventing device 42, thereupon over the rollers 145, 245 of the deflector 45 and thereafter over the rollers 143, 243 of the second skew preventing device 43. Each of the devices 42, 43 comprises a substantially box-shaped casing or enclosure for the respective rollers 342, 442 and 143, 243. The lower portions of such casings are pivotable about axes coinciding with the respective portions of the path for the web 3 and in predetermined web guiding planes to thereby compel the web to travel without moving askew toward the one or the other rail 10, 11. The path of the web 3 is preferably located midway between the rails 10, 11 and in register with the foraminous section 60 of the stationary screen 6. The axes of the rollers 342, 442 are located in a substantially vertical plane which is normal to the direction of movement of the carriage 4 toward or away from the limit switch 247, and the axes of the rollers 143, 243 are located in a substantially horizontal plane.

The positioning means for the web 3 further comprises a set of auxiliary stabilizing rollers 148 which are mounted on the carriage 4 downstream of the roller 143 of the skew preventing device 43. The web 3 which is trained over the auxiliary stabilizing rollers 148 is then trained over the counterpressure member 44 and moves past or through a monitoring device 49 which is located immediately upstream of the member 44. The monitoring device 49 can comprise a discrete photocell for each marginal portion of the web 3, a discrete perforating means for each marginal portion of the web, or both. The monitoring device 49 facilitates exact guidance and advancement of the web 3 along the path which is defined by the positioning means by forming or detecting suitable indicia which are provided in one or both marginal portions of the web. For example, the indicia may constitute holes or notches which are formed by the perforating means of the monitoring device 49. More specifically, detection of indicia on the web 3 can be used to control the forward and/or return movements of the carriage 4 with a high or very high degree of accuracy. The indicia are applied to the web 3 during a first pass of the carriage 4 and are detected to control the movements of the carriage during the next pass. The manner in which the indicia are applied to the web 3 and in which such indicia are detected and used to control the movements of a movable part of a screen printing machine is known per se; therefore (save for the fact that it controls the movements of the carriage 4 and that it is mounted on the carriage immediately upstream of the counterpressure member 44), the exact construction of the monitoring device 49 forms no part of the present invention.

The illustrated unit 5 comprises two applicators 51 and 52. The applicator 51 serves as a means (flood bar) for supplying the printing medium to the upper side of the screen section 60, and the applicator 52 serves as a means for forcing the thus supplied printing medium through the interstices of the section 60 and into contact with the web 3 opposite the counterpressure member 44. The reference character 55 denotes means for moving the applicators 51, 52 up and down toward and away from the upper side of the section 60. The moving means 55 includes one or more hydraulically or pneumatically operated cylinder and piston units; however, it is also possible to employ electric motors, electromagnetic moving means or others.

When the prime mover 46 is started (e.g., in automatic response to movement of the carriage 4 to its right-hand end position, as viewed in FIG. 1), the transmission 146 (e.g., one or more toothed belts trained over suitable pulleys on the output element of the prime mover 46 and on the stabilizing and synchronizing shaft 147), the pinions 47 rotate relative to the respective toothed racks 17 and cause the carriage 4 to advance in the direction of arrow A. Such leftward movement of the carriage 4 is shared by the components of the positioning means (save for the roller 25 which is installed in the support 1), by the counterpressure member 44 and by the unit 5. The bearings in which the counterpressure member 44 and the stabilizing device 48 rotate relative to the carriage 4 are not specifically shown in the drawing. As the carriage 4 advances in the direction of the arrow A, the applicator 51 spreads a layer of pasty printing medium on the upper side of the screen section 60 without causing the printing medium to penetrate through the section 60 and into contact with the web 3 therebelow. The source of printing medium and the means for feeding such medium to the applicator 51 are not shown. The section 60 of the screen 6 is not biased toward the counterpressure member 44 which moves in the direction of the arrow A. As mentioned above, the freewheel or freewheels 444 hold the member 44 against rotation about its axis while the pinion or pinions 344 roll along the respective toothed rack or racks 17. The suction chamber (**44*a*) in the interior of the hollow cylindrical shell of the member 44 attracts the adjacent portion of the web 3 while the distance between the carriage 4 and the feeding unit 2 increases. The applicator 51 can include or constitute a doctor-shaped squeegee which spreads out a pool 151 of printing medium along the upper side of the screen section 60 while the carriage 4 moves toward the limit switch 247. The stabilizing device 48 is also held against rotation (the same as the auxiliary stabilizing devices 148) while the carriage 4 moves toward the limit switch 247 so that the web 3 is drawn out of the feeding unit 2 and is located in the path which is defined by the positioning means including the rollers 25, 142, 242, skew preventing devices 42, 43, deflector 45, auxiliary stabilizing rollers 148 and device 48. As can be seen in FIG. 2, that length of the web 3 which is thereby extracted from the feeding unit 2 includes an elongated straight portion which is closely adjacent to and is located below the underside of the screen section 60. Such straight portion extends between the rollers 25 and 142. The rotary elements 20–23 and the roller 25 rotate about their respective axes but all rotary components of the web positioning means on the carriage 44** are at a standstill (i.e., they do not rotate about their respective axes).

When the carriage 4 reaches its left-hand end position (shown in FIG. 2), the limit switch 247 is actuated to transmit a signal which causes the moving means 55 to lift the applicator 51 while simultaneously lowering the applicator 52. This enables the applicator 52 (which can include a flexible doctor blade) to force the printing medium (which has been applied to the upper side of the screen section 60) through the interstices of the section 60 and into contact with the web 3 therebelow while the carriage 4 performs a printing stroke, i.e., while the carriage moves in the direction of arrow B back toward the starting position of FIG. 1. The prime mover 46 need not necessarily be reversed by the limit switch 247 but can receive an appropriate signal from the monitoring device 49. All that counts is to ensure that the carriage 4 moves in the direction of arrow B after the applicator 52 assumes its operative (lower end) position to force the printing medium through the interstices of the screen section 60 opposite the counterpressure member 44. The applicator 52 urges successive increments of the screen section 60 toward the counterpressure member 44 which rotates because the freewheel 444 then allows the pinion 344 to transmit torque to the cylindrical shell of the member 44. The web 3 then moves only within the confines of the carriage 4 and the length of the straight web portion between the rollers 25 and 142 decreases as the carriage 4 moves from the end position of FIG. 2 back toward the end position of FIG. 1. Were the member 44 mounted on a conveyance other than the carriage 4, the latter could remain in the position of FIG. 2 while the counterpressure member 44 and the applicator 52 move toward the end positions of FIG. 1. However, and in view of the aforediscussed construction of the machine which is shown in FIGS. 1 to 3, the carriage 4 and the parts 42, 43, etc. thereon share the rightward movement of the member 44 and of the applicator 52 toward the end positions of FIG. 1. The external surface of the air-permeable shell of the counterpressure member 44 rolls along the underside of the screen section 60 (actually along the underside of the adjacent portion of the web 3), and the air-permeable shell of the stabilizing device 48 also rolls along the underside of the adjacent portion of the web 3. Rotation of the shell of the member 44 entails a forward movement of the web 3 from the shell of the member 44 toward the shell of the device 48. The shell of the device 48 transports the web 3 forwardly (in the direction of arrow A) relative to the carriage 4 but not relative to the feeding unit 2 which is then idle.

It will be seen that, while the carriage 4 moves in the direction of the arrow B, the web 3 moves relative to the carriage in the direction of arrow A whereby the indicia on the web move past the monitoring device 49. This enables the device 49 to arrest the carriage 4 in the end position of FIG. 1 if the machine does not comprise a second limit switch 247 adjacent to the feeding unit 2. The limit switch or switches 247 are optional if the machine comprises the monitoring device 49 and vice versa. The device 49 is desirable and advantageous because it ensures highly accurate registration between succeeding print repeats.

The skew preventing devices 42 and 43 on the carriage 4 ensure that the orientation of the web 3 remains unchanged, i.e., that the web does not approach the rail 10 or 11 while the carriage moves in the direction of arrow A or B. The auxiliary stabilizing rollers 148 ensure that the web 3 is held against stray movements (e.g., flutter) during movement of the carriage 4 in the direction of arrow B.

The printing medium which is spread out on the screen section 60 by the applicator 51 while the carriage 4 moves in the direction of the arrow A can constitute a highly viscous ink, a dye, a gloss-enhancing agent, a stiffening agent, a softening agent, an impregnating agent or any other suitable chemical which can enhance the appearance and/or other desirable characteristics of the web 3. The screen section 60 can have uniformly distributed interstices if the applied printing medium is to uniformly coat the upper side of the web, or the section 60 may include or constitute a stencilled component which can apply to the web 3 one or more selected patterns or ornaments (this is shown schematically in FIG. 3). At the present time, the improved machine is used primarily for the application of one or more suitable printing media to webs of paper. However, and as mentioned above, the machine can be used with equal or similar advantage for the application of printing media to metallic or plastic foils, to webs of woven or non-woven textile material and/or others. Also, the machine can be used for the application of printing media to webs or sheets of finite length, i.e., not necessarily to substantial lengths of webs which are caused to advance from a supply reel to a takeup reel. It is further clear that the applicator 51 and/or 52 can constitute any one of a wide variety of conventional slotted or otherwise configurated squeegees which may but need not rotate during spreading and/or during application of printing media to the web. The unit 5 can include more than two applicators, e.g., two or more applicators for spreading a suitable printing medium and one applicator which causes the spread out medium to pass through the screen section 60, or vice versa. Means can be provided for guiding the applicator 52 or an analogous applicator while the latter is in the process of forcing the spread out printing medium through the interstices of the screen section 60.

As mentioned above, the feeding unit 2 is idle while the carriage 4 advances in the direction of arrow B. Thus, the rotary elements 20–23 do not rotate about their respective axes in directions to advance the web 3 toward the path which is defined by the positioning means on the carriage 4. The roller 25 is also at a standstill. The rocker 24 cooperates with the rotary elements 22, 23 thereon to maintain the web 3 under requisite tension.

The reference character 3' denotes in FIG. 1 an imprinted length of the web 3 which is located to the left of the stabilizing device 48 when the carriage 4 reassumes its starting position. Such length 3' is convoluted onto the aforementioned takeup reel.

An important advantage of the improved machine is that it employs a screen 6 which is stationary when the machine is in actual use. This is achieved in that the counterpressure member 44 is mounted for movement relative to the stationary screen. Such design results in a surprisingly pronounced shortening of the machine. Thus, the overall length of the support 1 can equal or need not appreciably exceed the length of the screen 6 (as considered in the direction of the arrow A or B). This entails a 50-percent reduction of overall length of the machine in comparison with the aforediscussed conventional machine having a reciprocable screen which moves to both sides of a fixedly installed counterpressure member. At the very least, the length of the machine can be reduced by 30 percent. The feeding unit 2 does not take up much room so that the length of the machine is determined primarily by the length of the screen 6. The advantages of a more compact machine (especially a machine whose length is only between 50 and 70 percent of the length of a conventional machine) will be readily appreciated. Thus a larger number of machines can be installed in a given area of a plant or the dimensions of the plant can be reduced if the number of machines is to remain the same.

Another important advantage of the improved machine is that its cost is also a fraction of the cost of conventional machines. This is attributable to savings in material for the support and other parts (such as the long guides for the reciprocable screen of a prior art machine). The cost of means (carriage 4 and the means for reciprocating the carriage) for reciprocating the member 44 need not exceed the cost of means for reciprocating the screen in a conventional machine.

FIGS. 4 to 7 show a second embodiment of the improved machine wherein the support 1 is somewhat longer so that the carriage 4 can be moved to an end position (shown in FIGS. 6 and 7) in which the entire upper side of the screen 6 is unobstructed. This allows for convenient access to the screen 6 for the purposes of inspection, repair and/or replacement. The reference characters which are used in FIGS. 4 to 7 are generally the same as those used in FIGS. 1 to 3 and denote parts identical with or similar to those used in the machine of FIGS. 1 to 3.

Figure 4:
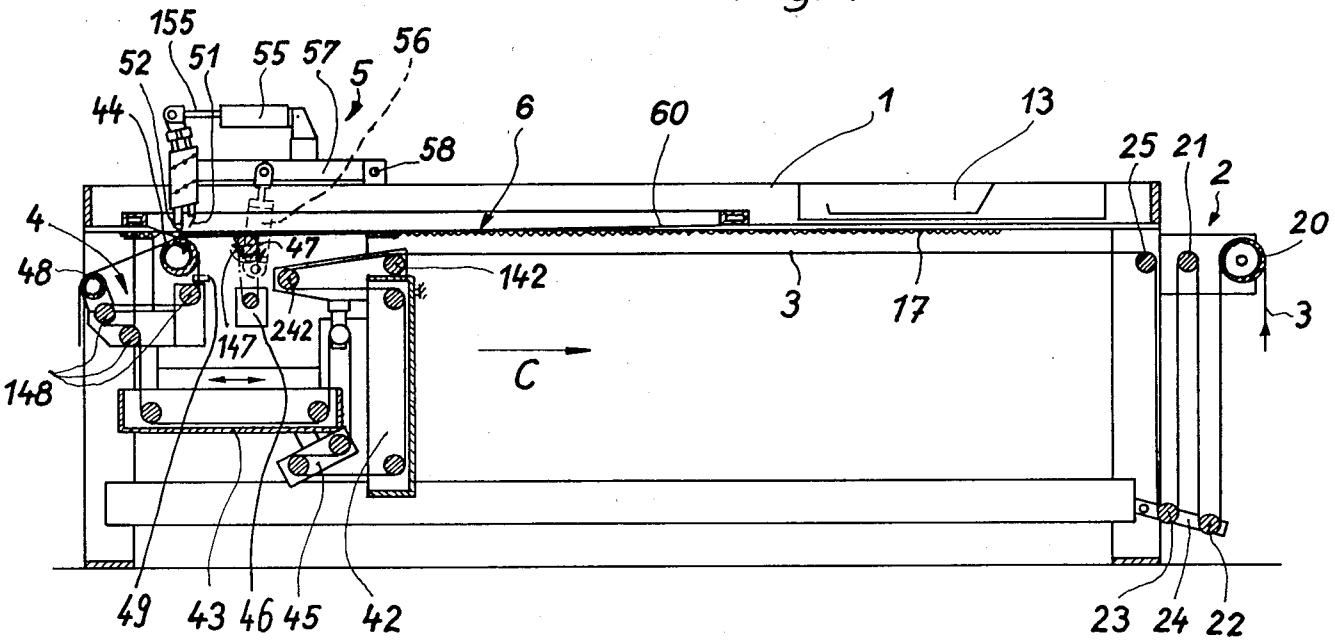
FIG. 4 is a longitudinal vertical sectional view of a second screen printing machine, the carriage being shown in the position it assumes prior to start of a printing stroke.
Figure 6:
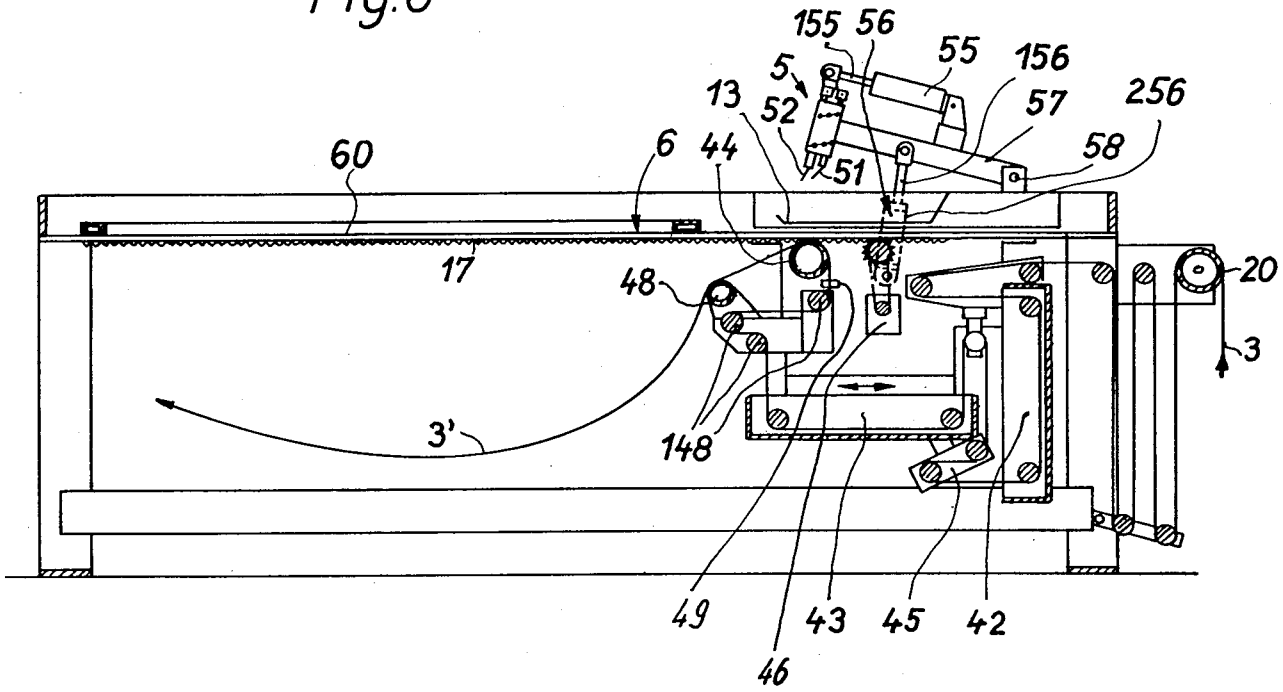
FIG. 6 shows the structure of FIG. 5, with the means for applying the printing medium located laterally of and out of register with the screen.
Figure 7:
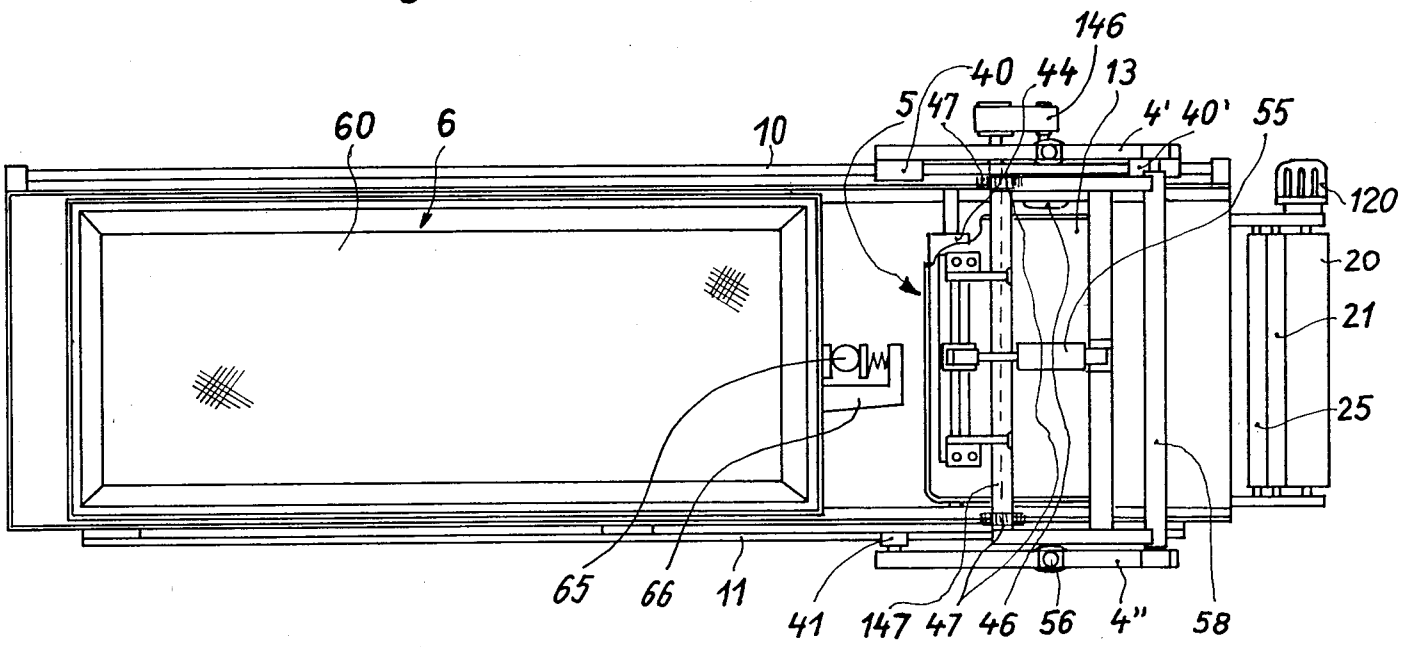
FIG. 7 is a plan view of the structure which is shown in FIG. 6.

FIG. 4 shows the carriage 4 in its starting position prior to begin of a printing stroke. As can be readily seen in FIG. 4, the support 1 is somewhat longer than the screen 6 so that the support can accommodate the carriage 4 and the parts which are mounted thereon adjacent to the right-hand end of the frame of the screen 6. This renders the screen 6 readily accessible as soon as the carriage 4 is moved to the end position which is shown in FIGS. 6 and 7. Removal of the screen 6 involves a simple lifting above and away from the support 1, and placing of the screen back to its operative position merely involves a lowering of the screen onto the corresponding portion of the support 1. The rails 10, 11 of the ways for the carriage 4 are longer than in the embodiment of FIGS. 1 to 3; the screen 6 is installed between first (left-hand) portions of such rails and the second (right-hand portions of the rails support the carriage 4 when the latter is moved to the end position of FIGS. 6 and 7. The machine of FIGS. 4 to 7 employs relatively long toothed racks 17 so that the pinions 47 can remain in mesh therewith while the carriage 4 moves between the end position of FIGS. 6–7 and the end position of FIG. 4.

The support 1 carries an open-top vessel 13 which can constitute a simple pan or the like and is disposed below the applicators 51, 52 of the printing medium applying unit 5 when the carriage 4 is moved to the end position of FIGS. 6 and 7. This ensures that any droplets of printing medium which descend from the applicators 51 and 52 are intercepted by the pan 13 and cannot contaminate the web 3 therebelow. The bottom wall of the pan 13 can be disposed at or close to the level of the at least partially foraminous section 60 of the screen 6.

The construction and mounting of the carriage 4 and counterpressure member 44 correspond generally to those of the parts 4 and 44 in the machine of FIGS. 1 to 3. When the carriage 4 dwells in the position of FIG. 4 (i.e., at a maximum distance from the web feeding unit 2), the applicator 52 is held in the operative (lowered) position so that it can force a suitable printing medium through the interstices of the section 60. At the same time, the applicator 52 urges the adjacent portion of the section 60 toward the counterpressure member 44. The prime mover 46 then causes the carriage 4 to move in the direction of arrow C and toward the intermediate position of FIG. 5. The length of the web portion between the carriage 44 and the feeding unit 2 decreases and the carriage leaves behind it a length 3' of imprinted web material. The length 3' is or can be slightly looped prior to collection on the core of the takeup reel.

Figure 5:
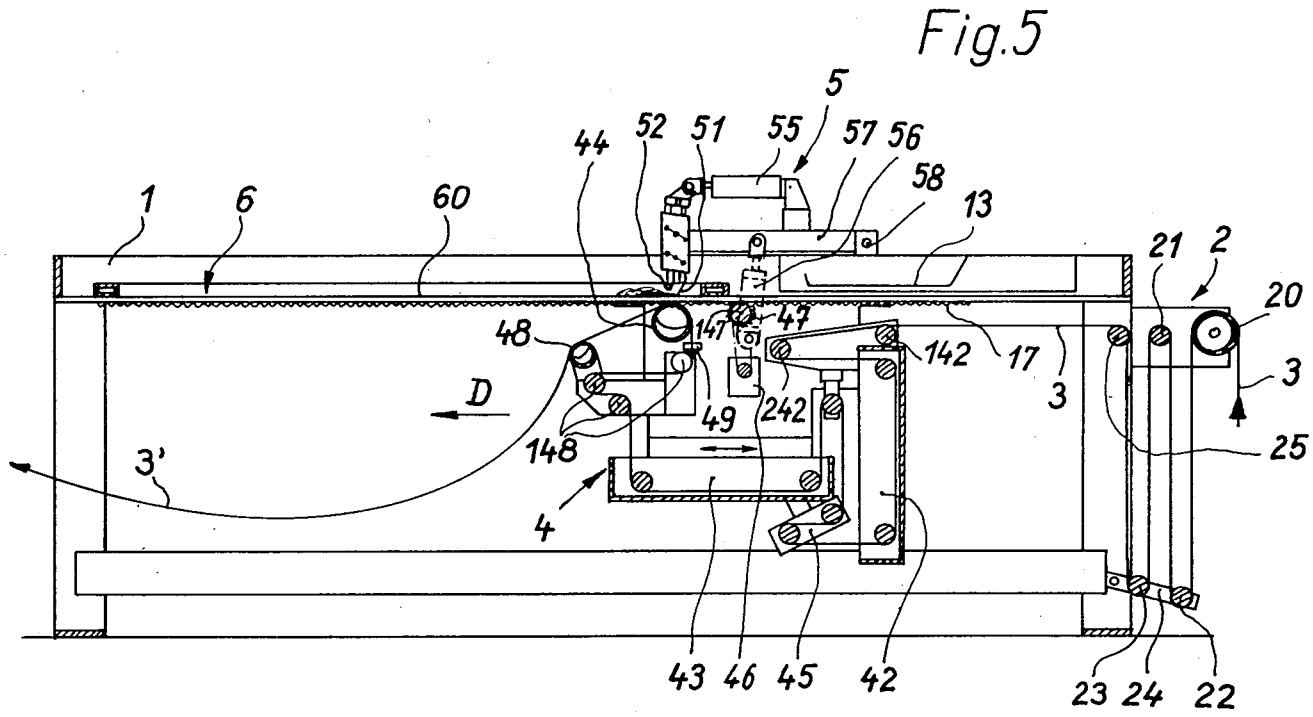
FIG. 5 shows the structure of FIG. 4, with the carriage in a position it assumes upon completion of a printing stroke.

When the carriage 4 reaches the intermediate position of FIG. 5, the applicator 52 is lifted and enables the adjacent portion of the screen section 60 to move upwardly and away from the counterpressure member 44. The applicator 51 of the unit 5 is lowered and the carriage 4 is ready to move back toward the position of FIG. 4 (arrow D in FIG. 5). The intermediate position (FIG. 5) of the carriage 4 corresponds to that position of the carriage of the first machine which is shown in FIG. 1.

If and when it becomes necessary to gain access to the entire screen 6, the prime mover 46 receives a signal to advance the carriage 4 beyond the intermediate position of FIG. 5 and to the end position of FIGS. 6 and 7. As explained above, this renders it possible to simply lift the screen 6 above and away from the support 1 or to lower the same screen or a different screen onto the support 1 adjacent to the fully retracted carriage 4. A magazine for a smaller or larger supply of spare screens 6 can be installed at a level above the path of movement of the unit 5 with the carriage 4 so that the magazine is out of the way when the machine of FIGS. 4 to 7 is in actual use. Once the carriage 4 is retracted to the end position of FIGS. 6 and 7, the exposed screen 6 can be manually or automatically lifted off the support 1 and manually or automatically replaced with a spare or substitute screen. The transfer mechanism for screens and the magazine for spare screens are not specifically shown in the drawing. In spite of the fact that the support of FIGS. 4 to 7 is longer than the support of FIGS. 1–3, the length of the support of FIGS. 4–7 need not exceed approximately 70 percent of the length of the support in a machine with a reciprocable screen so that the savings in space and material are still quite substantial. In addition, the machine of FIGS. 4 to 7 renders it possible to gain totally unobstructed access to the screen 6 and to install a magazine and (if desired) automatic or semiautomatic screen transfer means between the magazine and the support 1.

The mounting of the unit 5 on the carriage 4 of FIGS. 4 to 7 is somewhat different from the mounting of the unit 5 in FIGS. 1 to 3. Thus, the unit 5 of FIGS. 4 to 7 is mounted on a pivotable carrier 57 (i.e., it is not rigidly affixed to the sidewalls or cheeks 4', 4'' of the carrier 4). An advantage of the pivotable carrier 57 is that it renders it possible to lift the unit 5 above the level of the vessel or pan 13 when the carriage 4 is to be moved beyond the intermediate position of FIG. 5 and to the end position of FIGS. 6 and 7. The carrier 57 is pivotable about the axis of a shaft 58 on the carriage 4 by one or more motors 56 here shown as pneumatically or hydraulically operated cylinder and piston units. The piston rods 156 of such cylinder and piston units 56 are articulately connected to the carrier 57 and the cylinders 256 of such units are articulately connected to the carriage 4. FIGS. 4 to 7 show that the carrier 57 is pivotable by two cylinder and piston units 56. Pivoting of the unit 5 to the position which is shown in FIG. 6 affords even more convenient access to the adjacent portion of the screen 6. The extent of pivoting of the carrier 57 is preferably selected in such a way that the unit 5 is lifted sufficiently above the screen 6 and above the pan 13 even if the applicator 51 and/or 52 of the unit 5 is held in its lower end position. FIG. 6 shows that the applicators 51, 52 are disposed at a level above the open top of the pan 13 when the carriage 4 assumes its right-hand end position. This ensures that droplets of printing medium cannot contaminate the web 3 below the unit 5. Such droplets are further prevented from contaminating the carriage 4.

The means for moving the applicators 51, 52 of the unit 5 in the machine of FIGS. 4 to 7 up and down again comprises a fluid-operated motor 55 which is mounted on the carrier 57 and is designed to pivot the applicators relative to the carrier 57. The motor 55 has a cylinder which is articulately connected with an upwardly extending bracket of the carrier 57 and a piston rod 155 which is articulately connected to a holder for the applicators 51 and 52. An advantage of the motor 55 and its mounting as shown in FIGS. 4 to 7 is that this motor can cooperate with the motors 56 to change the levels as well as the orientation of the applicators 51, 52. For example, the inclination of the applicator 51 may be changed in order to place the applicator 51 in an optimum position for the spreading of a printing medium having a given viscosity. Such adjustability of the applicators 51, 52 (and especially of the applicator 51) ensures that the printing medium can be spread out along the upper side of the screen section 60 with a very high degree of predictability and reproducibility as well as that the applicator 51 can be used for predictable spreading of different types of printing media having different consistencies and/or other characteristics.

It will be noted that the moving means 55 can be designed to simply move the applicator 51 and/or 52 up or down (as shown in FIGS. 1 to 3) or to move the applicator 51 and/or 52 up and down as well as to simultaneously pivot the selected applicator or all applicators about one or more horizontal axes extending transversely of the direction of advancement of the web from the feeding unit 2. All that counts is to ensure that the selected applicator can be moved to and held in its operative or retracted position and that the unit 5 can be advanced beyond the screen 6 to such an extent that the screen 6 can be simply lifted out of the support 1 or can be otherwise moved in order to leave its operative position for replacement with a different screen or to undergo inspection and/or repair outside of the machine.

FIG. 7 further shows simple retaining (detent) and locating means 65, 66 for the frame of the screen 6. Such locating means ensure that each of a series of successively inserted screens 6 is automatically moved to and held in an optimum position with reference to the support 1 and with reference to the path of the web 3 in the support, i.e., outside of the feeding unit 2.

The carriage 4 of FIGS. 4 to 7 can be caused to move between its normal end positions of FIGS. 4 and 5 as well as to and from its end position of FIGS. 6–7 in response to actuation of one or more limit switches (not specifically shown in FIGS. 4–7) and/or in response to signals from the monitoring means 49. The monitoring means again detects the presence or absence of indicia which are applied to the web 3 during a first pass and are detected during the next-following pass. The manner in which the limit switch(es) and/or monitoring device 49 are connected with the controls for the prime mover 46 and/or with the controls for the means for moving the applicators 51, 52 relative to the carriage 4 is not shown because it forms no part of the invention.

It is further within the purview of the invention to replace the illustrated counterpressure member 44 and/or the illustrated stabilizing device 48 with a member having a relatively thick cylindrical peripheral layer of elastomeric material, e.g., natural or synthetic rubber.

As mentioned above, the carriage 4 for the unit 5 need not be the same carriage which supports the counterpressure member 44. However, the illustrated machines are preferred at this time due to their simplicity and compactness. Moreover, the illustrated mounting of the counterpressure member 44 on the carriage 4 for the unit 5 ensures adequate synchronization of movements of the member 44 and applicators 51, 52 as well as accurate registry between the applicator 52 and the member 44 while the carriage 4 performs a printing stroke.

Tab applicators are disclosed in U.S. Pat. No. 3,779,160 and photocells for ensuring accurate registry of the web at the printing station are disclosed in U.S. Pat. No. 3,848,528. There are monitoring devices upstream and downstream of the printing station.

Adjusting frames performing the functions of the devices 42, 43 are disclosed in U.S. Pat. No. 3,848,528.

The combination of a squeegee blade and a flood bar is disclosed in U.S. Pat. Nos. 4,365,551, 2,814,987, 2,783,709 and 3,779,160.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine for discontinuous screen printing on an elongated web of material, the combination of a support; a substantially flat stationary printing screen on said support, said screen having an upper side and an underside; a cylindrical counterpressure member adjacent to the underside of said screen means for positioning the web between said counterpressure member and said underside of said screen including means for advancing the web in a predetermined direction and along a predetermined path, said counterpressure member being reciprocable in and counter to said direction and said advancing means including said counterpressure member and a web stabilizing device located downstream of said counterpressure member in said direction, said counterpressure member comprising an air-permeable hollow rotary cylindrical shell and means for evacuating air from the shell so that the latter can attract the adjacent portion of the web and can secure the web and roll the web across the screen without slippage; means for intermittently rotating said shell so that the shell is held against rotation during movement of said counterpressure member in said direction and that the shell rotates during movement of said counterpressure member counter to said direction; means for reciprocating said counterpressure member along said underside of said screen, including a carriage for said counterpressure member and means for reciprocating said carriage relative to said screen; means for applying a printing medium to the web through said screen, including a plurality of discrete applicators, one of said applicators including means for supplying the printing medium to the upper side of the screen and another of said applicators including means for forcing the applied printing medium through the screen into contact with the web; means for securing said applying means to said carriage;

and means for moving said applicators up and down relative to said carriage.

2. The combination of claim 1, further comprising at least one skew preventing device for the web, said device being mounted on said carriage.

3. The combination of claim 1, further comprising a plurality of mutually inclined skew preventing devices for the web, said devices being mounted on said carriage.

4. The combination of claim 1, wherein said carriage comprises a pair of spaced apart walls and further comprising carrier means provided on said walls and supporting said applying means.

5. The combination of claim 1, wherein said support comprises ways and said carriage includes a portion which is supported by and is reciprocable along said ways.

6. The combination of claim 1, wherein said stabilizing device includes a hollow air-permeable cylindrical shell adjacent to said path, means for evacuating air from said shell so that the latter attracts the adjacent portion of the web, and means for intermittently rotating said shell.

7. The combination of claim 1, further comprising web monitoring means adjacent to said path and disposed upstream of said counterpressure member, as considered in said direction.

8. The combination of claim 7, wherein said monitoring means comprises at least one photocell.

9. The combination of claim 7, wherein said monitoring means includes at least one web perforating device.

10. The combination of claim 1, further comprising means for feeding the web into said path, said feeding means including a plurality of rotary elements defining for the web a meandering second path and means for intermittently rotating at least one of said elements.

11. The combination of claim 10, wherein said feeding means further comprises rocker means for pivotally mounting at least two of said rotary elements, the web being looped around the rotary elements on said rocker means.

12. The combination of claim 11, wherein said feeding means includes an upper portion adjacent to said predetermined path and a lower portion including said rocker means and the rotary elements thereon.

13. The combination of claim 1, wherein said means for reciprocating said carriage relative to said screen includes means for reciprocating the carriage to and from a predetermined end position, said applying means being remote from said screen in said predetermined position of said carriage.

14. The combination of claim 13, wherein said support includes elongated ways for said carriage, said screen being adjacent to a first portion of said ways and said carriage being supported by a different second portion of said ways in said predetermined position thereof.

15. The combination of claim 1, wherein said moving means includes means for pivoting said applying means.

16. The combination of claim 1, wherein said reciprocating means comprises means for reciprocating said carriage relative to said screen to and from a predetermined position, and further comprising an open-top vessel provided on said support, said applying means being mounted on said carriage at the upper side of said screen and being remote from said screen and located above said vessel in said predetermined position of said carriage.

* * * * *